US007713038B2

(12) United States Patent
Ishikawa et al.

(10) Patent No.: US 7,713,038 B2
(45) Date of Patent: May 11, 2010

(54) SCROLL FLUID MACHINE

(75) Inventors: Hidetoshi Ishikawa, Yokohama (JP); Naohiro Minekawa, Yokohama (JP)

(73) Assignee: Anest Iwata Corporation, Yokohama (JP)

( * ) Notice: Subject to any disclaimer, the term of this patent is extended or adjusted under 35 U.S.C. 154(b) by 187 days.

(21) Appl. No.: 11/964,106

(22) Filed: Dec. 26, 2007

(65) Prior Publication Data

US 2008/0152528 A1 Jun. 26, 2008

(30) Foreign Application Priority Data

Dec. 26, 2006 (JP) ..... 2006-349522

(51) Int. Cl.
*F01C 1/02* (2006.01)
*F03C 2/00* (2006.01)

(52) U.S. Cl. ..... 418/55.3; 418/55.1; 418/55.2; 418/83; 418/86; 418/101

(58) Field of Classification Search ..... 418/101, 418/55.1, 55, 2, 55.3, 83, 85, 86
See application file for complete search history.

(56) References Cited

U.S. PATENT DOCUMENTS

| | | | | |
|---|---|---|---|---|
| 6,109,897 | A * | 8/2000 | Haga | 418/101 |
| 7,329,108 | B2 * | 2/2008 | Tsuchiya et al. | 418/101 |
| 2005/0169788 | A1 * | 8/2005 | Komai et al. | 418/55.1 |
| 2006/0233656 | A1 * | 10/2006 | Matsushima | 418/55.5 |

FOREIGN PATENT DOCUMENTS

| | | | |
|---|---|---|---|
| JP | 63-43427 | Y2 | 11/1988 |
| JP | 01273893 | A * | 11/1989 |

* cited by examiner

*Primary Examiner*—Thomas E Denion
*Assistant Examiner*—Mary A Davis
(74) *Attorney, Agent, or Firm*—Polsinelli Shughart PC

(57) ABSTRACT

A scroll fluid machine comprises a driving shaft in a housing. An orbiting scroll is eccentrically revolved around an eccentric axial portion of the driving shaft via a bearing. Air is introduced from outside through an intake port of a circumferential wall of the housing and directed toward the bearing by a guide to cool the bearing.

4 Claims, 4 Drawing Sheets

SCROLL FLUID MACHINE

BACKGROUND OF THE INVENTION

The present invention relates to a scroll fluid machine such as a scroll compressor or a scroll vacuum pump.

A scroll fluid machine comprises a driving shaft driven by an electric motor and comprising an eccentric axial portion at one end; an orbiting scroll rotatably mounted around the eccentric axial portion via a bearing and having an orbiting wrap on an orbiting end plate; and a fixed scroll having a fixed wrap on a fixed end plate. The orbiting wrap engages with the fixed wrap to form a sealed chamber. A self-rotation-preventing device is provided to prevent the orbiting scroll from rotating on its own axis.

The orbiting scroll is eccentrically revolved with the eccentric axial portion of the driving shaft and self-rotation-preventing device. The sealed chamber is gradually decreased in volume toward the center to allow fluid sucked from the outer circumference to be compressed, or is gradually increased away from the center to allow fluid sucked from the center to be decompressed and discharged from the outer circumference.

In such a scroll fluid machine, thermal load increases with compression and expansion. Especially, heat significantly affects a rotary part or a bearing rotatably supporting the eccentric axial portion of the orbiting scroll. JP63-43427Y2 discloses that an axial fan is provided in the housing of the scroll fluid machine to allow external air taken in from the inlet to blow into the rear surface of the sealed or compression chamber and to be discharged from the outlet to the housing.

The scroll fluid machine can transfer external air sucked from the inlet to the rear surface of the sealed chamber and a bearing for the driving shaft close to the rear wall of the housing, but it cannot flow air to a bearing for the eccentric axial portion which cannot effectively be cooled.

SUMMARY OF THE INVENTION

In view of the disadvantages in the prior art, it is an object of the present invention to provide a scroll fluid machine in which a bearing of an eccentric axial portion of a driving shaft can be cooled effectively.

BRIEF DESCRIPTION OF THE DRAWINGS

The features and advantages of the invention will become more apparent from the following description with respect to embodiments as shown in accompanying drawings wherein.

DETAILED DESCRIPTION OF PREFERRED EMBODIMENTS

Figure 1:
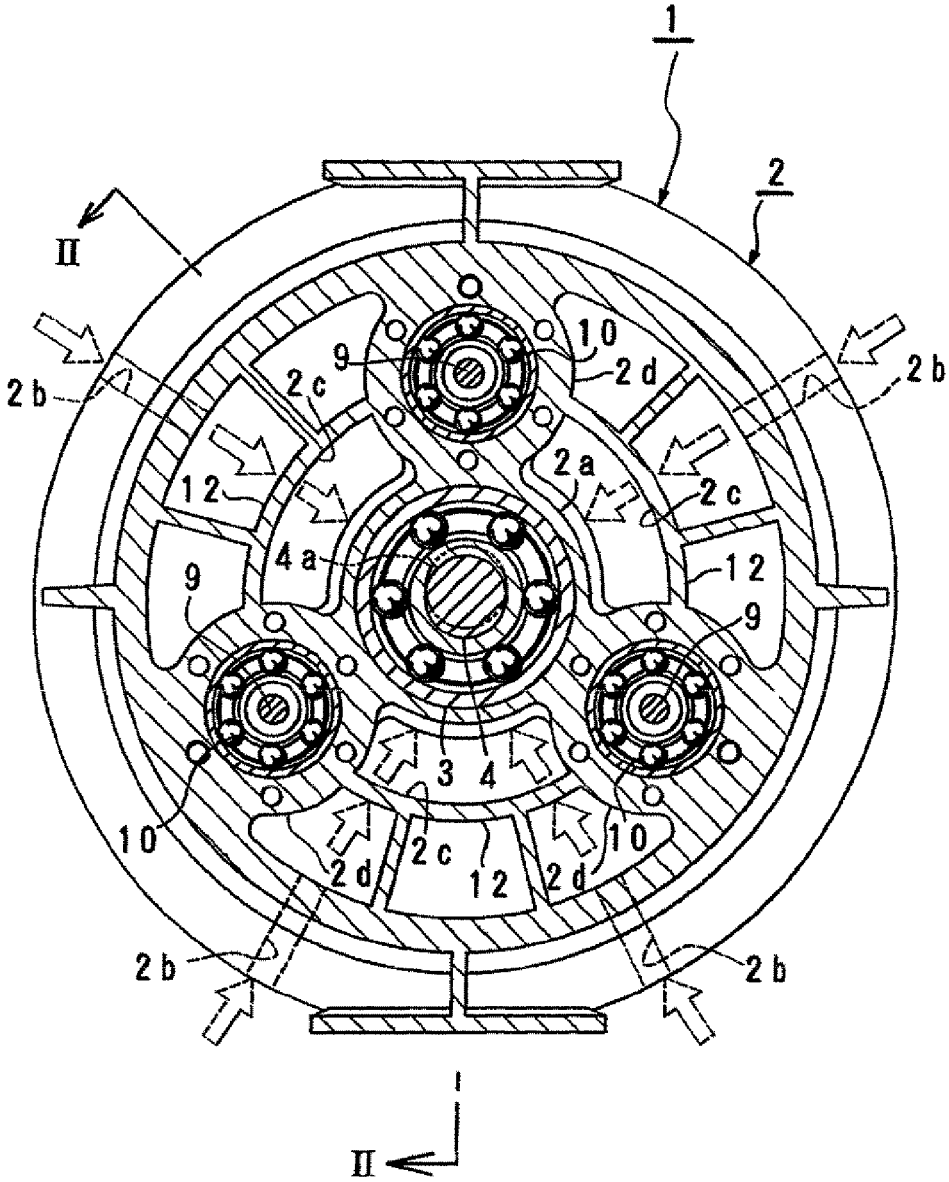
FIG. 1 is a vertical sectional view of a scroll fluid machine according to the present invention.
Figure 2:
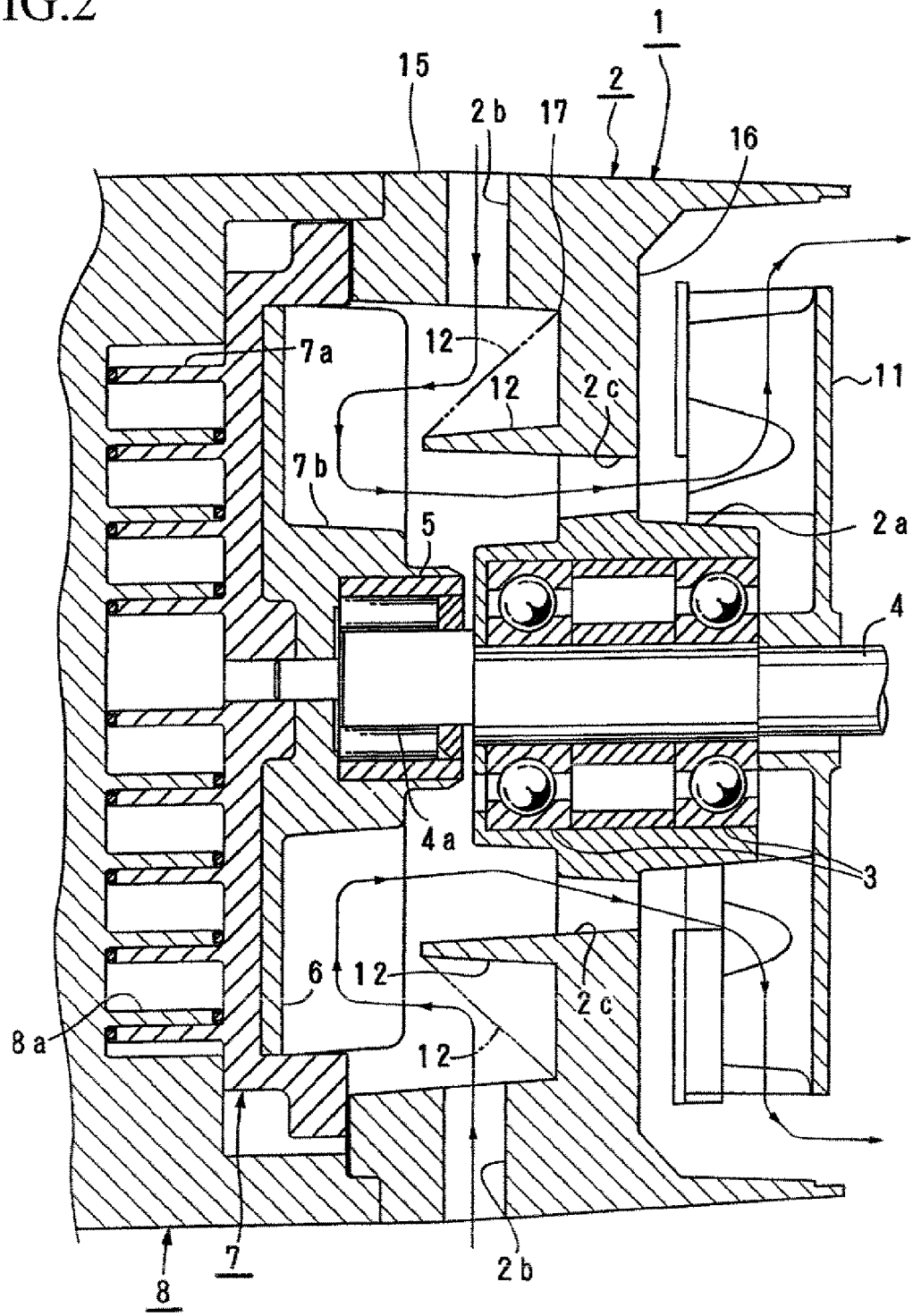
FIG. 2 is an enlarged vertical sectional view taken along the line II-II in FIG. 1.

The left side in FIG. 2 is deemed as "the front", and the right side is as "the rear".

A scroll fluid machine 1 comprises a housing 2 having a cylindrical bearing 2*a* in the center; a driving shaft 4 rotatably mounted to the bearing 2*a* via a ball bearing 3; an orbiting scroll 7 rotatably mounted to an eccentric axial portion 4*a* at the front end of the driving shaft 4 and comprising an orbiting end plate 6 having an orbiting wrap 7*a* on the front face; a fixed scroll 8 having a fixed wrap 8*a* on the rear surface of a fixed end plate (not shown) to engage with the orbiting wrap 7*a*; and three crank pins 9 or self-rotation-preventing devices for preventing the orbiting scroll 7 from rotating on its own axis. When the orbiting scroll 7 is revolved with rotation of the driving shaft 4, a sealed chamber is formed between the orbiting wrap 7*a* and the fixed wrap 8*a* so that a gas sucked from an inlet (not shown) is compressed and discharged from an outlet (not shown). A bearing 5 of the eccentric axial portion 4*a* is provided in a cylindrical bearing portion 7*b* at the center of the orbiting scroll 7.

The crank pins 9 as self-rotation-preventing devices are circumferentially spaced at an angle of 120 degrees between the orbiting scroll 7 and housing 2. The front end of the crank pin 9 is pivotally mounted to a bearing portion (not shown) of the orbiting scroll 7 via a ball bearing (not shown), and the rear end is pivotally mounted in a cylindrical boss 2*d* of the inner wall of the housing 2 via a ball bearing 10.

The rear end of the driving shaft 4 is mounted to an electric motor (not shown) and a cooling fan 11 is mounted on the outer circumference of the driving shaft 4 which projects rearward from the bearing portion 2*a* of the housing 2. The cooling fan 11 rotates with the driving shaft 4 to generate cooling wind rearward.

Four intake ports 2*b* for introducing external air are formed on the outer circumference of the housing 2 and three discharge ports 2*c* for discharging air taken in the housing 2 from the intake port 2*b*.

With rotation of the cooling fan 11 with the driving shaft 4, when cooling wind is blown rearward, a gas is sucked into the housing 2 via the discharge port 2*c*. Owing to negative pressure in the housing 2, external air is introduced from the intake port 2*b* to allow inside of the housing 2 to be cooled with flowing air.

In the housing 2, ribs 12 project axially from the front surface of a vertical rear wall 16 of the housing 2 so that air taken in the housing 2 from the intake port 2*b* is directed toward the bearing 5 of the eccentric axial portion 4*a*. The ribs 12 reinforce the bearing 2*d* of the crank pin 9 and prevent the bearing portion 2*d* from being deformed.

The ribs 12 are disposed in the vicinity of the intake port 2*b* and surround the discharge port 2*c*. The ribs 12 extend concentrically with the bearing 2*a* from the inner vertical rear wall 16 of the housing 2 to surround the bearing 5 for the eccentric axial portion 4*a* and extend circumferentially to connect circumferentially-adjacent bosses 2*d* to each other.

As shown by an arrow in FIG. 2, air taken in the housing 2 from the intake port 2*b* moves along the boss 2*d* of the crank pin 9 toward the center and then moves over the rib 12 to the bearing portion 7*b* of the eccentric axial portion 4*a*. Air moves rearward along the outer circumference of the bearing portion 7*b*. Heated air is discharged from the discharge port 2*c* to the outside. Thus, the eccentric axial portion 4*b*, the bearing 5 and their surroundings are cooled effectively.

The ribs 12 connect the circumferentially adjacent bosses 2*d* of the crank pin 9 to each other to reinforce the boss 2*d* to increase rigidity. Thus, the axis of the crank pin 9 is prevented from tilting, or a gap between the bosses 2 is prevented from varying owing to heat and load produced with revolution of the orbiting scroll 7.

As shown by two-dotted lines in FIG. 2, the surface of the rib 12 which faces the intake port 2*b* may be inclined to allow air to flow more positively toward the bearing 5. The rib 12 extends and is inclined from an internal corner 17 between the circumferential wall 15 and the vertical wall 16.

Figure 3:
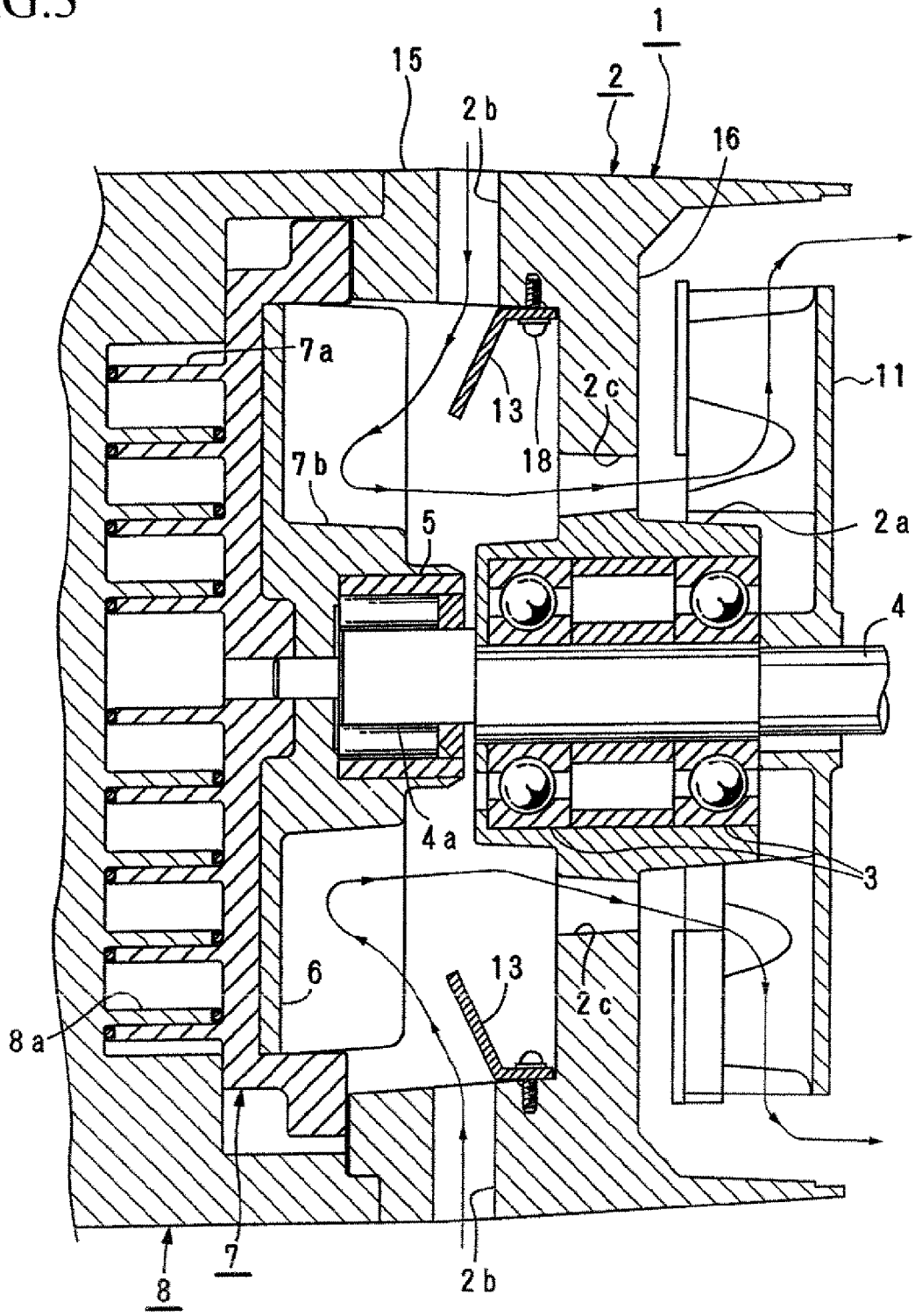
FIG. 3 is a vertical sectional view of another embodiment of the present invention and similar to FIG. 2.

In FIG. 3, the guide plate 13 may be formed separately from the housing 2 and may be mounted on the lower surface of the circumferential wall 15 with a bolt 18 in the vicinity of the end of the intake port 2*b* in the housing 2 so that the guide surface for air is more inclined toward the bearing 5. Accordingly, the guide plate 13 can be adjusted in a direction or inclination through the intake port 2*b* of the housing 2 from the outside.

Figure 4:
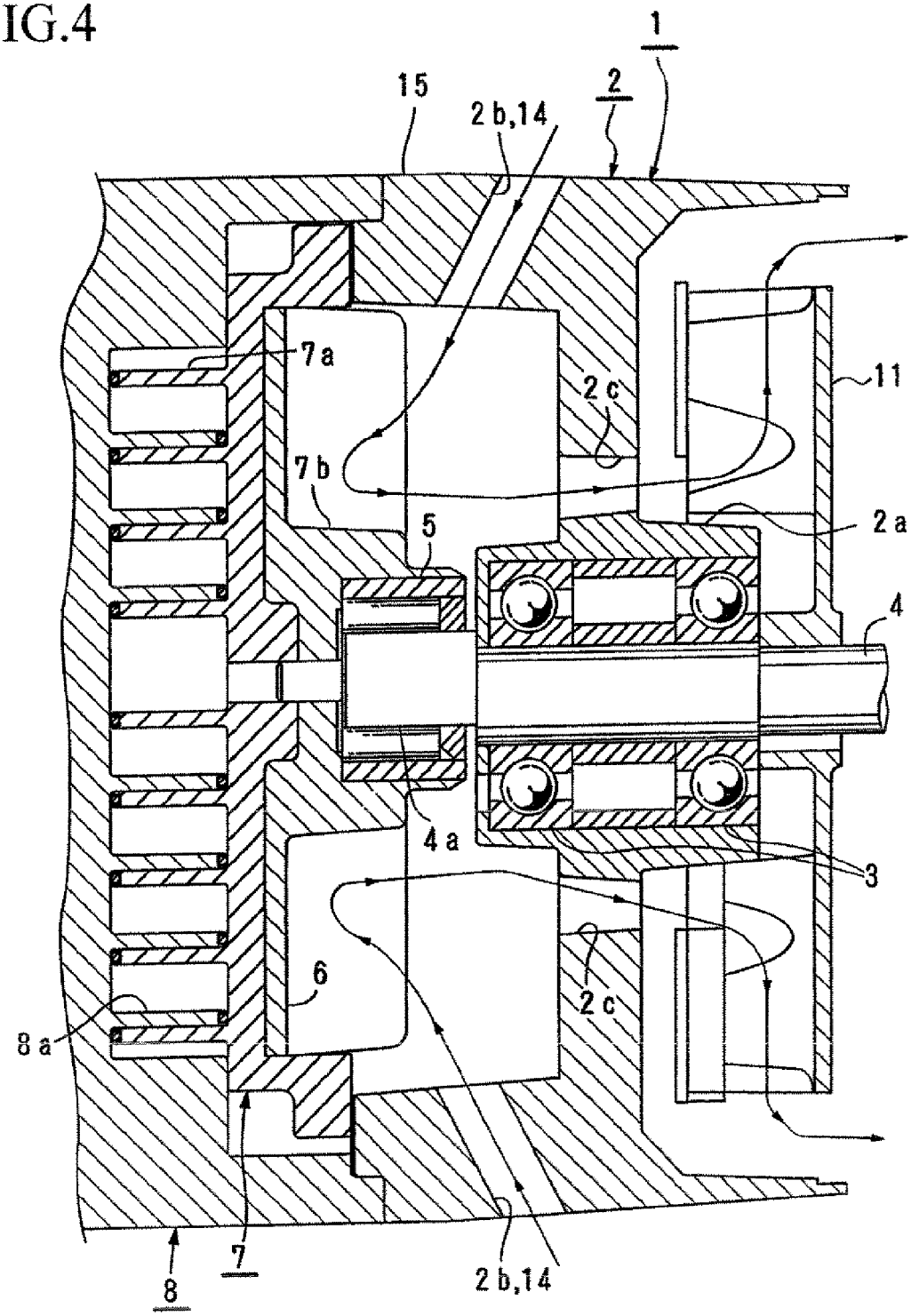
FIG. 4 is a vertical sectional view of further embodiment of the present invention and similar to FIG. 2.

In FIG. 4, an intake port 2*d* in the circumferential wall 15 of the housing 2 is inclined or curved toward the eccentric axial portion 4*a* of the driving shaft 4 and the bearing 5 in the housing 2. Air can be transferred in a desired direction without a guide in the housing 2.

The foregoing merely relates to embodiments of the invention. Various changes and modifications may be made by those skilled in the art without departing from the scope of claims.

What is claimed is:

1. A scroll fluid machine comprising:

a driving shaft comprising an eccentric axial portion at one end with a bearing;

a housing comprising an intake port, a discharge port, a plurality of bosses and a plurality of ribs which project from a vertical wall of the housing concentrically with the bearing to connect the plurality of bosses to each other, the plurality of ribs guiding external air introduced through the intake port toward the bearing of the eccentric axial portion to allow the air to cool the bearing;

an orbiting scroll rotatably mounted around the eccentric axial portion of the driving shaft via the bearing and having an orbiting wrap;

a fixed scroll fixed to the housing and having a fixed wrap that engages with the orbiting wrap to form a sealed chamber between the fixed wrap and the orbiting wrap; and a plurality of self-rotation-preventing devices that prevent the orbiting scroll from rotating on its own axis, each of the plurality of self-rotation-preventing devices comprising a crank pin in each of the plurality of bosses of the housing.

2. A scroll fluid machine of claim 1 wherein each of the plurality of ribs has a surface that faces the intake port and is inclined from an internal corner between a circumferential wall and the vertical wall of the housing.

3. A scroll fluid machine of claim 1 further comprising an inclined guide plate mounted on a lower surface of a circumferential wall of the housing with a bolt.

4. A scroll fluid machine of claim 1 wherein the intake port is inclined to direct air from an outside toward the bearing of the eccentric axial portion of the driving shaft.

* * * * *